US010899580B2

(12) United States Patent
Schmidt et al.

(10) Patent No.: US 10,899,580 B2
(45) Date of Patent: Jan. 26, 2021

(54) ELEVATOR CAB SUSPENSION ASSEMBLY FOR A DOUBLE DECK ELEVATOR

(71) Applicant: OTIS ELEVATOR COMPANY, Farmington, CT (US)

(72) Inventors: Walter Thomas Schmidt, Marlborough, CT (US); Enrico Manes, Feeding Hills, MA (US); Shihemn Chen, Bolton, CT (US); Zaffir A. Chaudhry, South Glastonbury, CT (US); Xiaodong Luo, South Windsor, CT (US); Luke A. Mishler, Manchester, CT (US); Bruce P. Swaybill, Farmington, CT (US); Richard J. Ericson, Southington, CT (US); Loi Cheng, South Windsor, CT (US); Meghan Mastriano, East Haven, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 397 days.

(21) Appl. No.: 15/871,480

(22) Filed: Jan. 15, 2018

(65) Prior Publication Data

US 2019/0218067 A1 Jul. 18, 2019

(51) Int. Cl.
*B66B 11/02* (2006.01)
*B66B 9/00* (2006.01)

(52) U.S. Cl.
CPC ..... *B66B 11/022* (2013.01); *B66B 9/00* (2013.01); *B66B 2201/306* (2013.01)

(58) Field of Classification Search
CPC ..... B66B 11/022; B66B 11/0213; B66B 2201/306; B66B 2201/308; B66B 2009/006
See application file for complete search history.

(56) References Cited

U.S. PATENT DOCUMENTS 5,526,901 A 6/1996 Salmon
6,334,511 B1 1/2002 Araki
(Continued)

FOREIGN PATENT DOCUMENTS

CN 101898713 A 12/2010
EP 1357075 A1 10/2003
(Continued)

OTHER PUBLICATIONS

English Machine Translation of KR 2013-0117834.*
Extended European Search Report for Application No. EP 19 15 1819 dated Jun. 24, 2019.

*Primary Examiner* — Diem M Tran
(74) *Attorney, Agent, or Firm* — Carlson, Gaskey & Olds

(57) ABSTRACT

An illustrative example elevator system includes a frame, a first elevator cab, a second elevator cab, and a plurality of sheaves associated with the first and second elevator cabs, respectively. A suspension assembly suspends the first and second elevator cabs within the frame. The suspension assembly has two ends in a fixed position relative to the frame. The suspension assembly includes a positive drive load bearing member along a first portion of a length of the suspension assembly and at least one other second load bearing member. A machine includes a drive sprocket that moves the positive drive load bearing member to cause movement of the first and second elevator cabs relative to the frame.

20 Claims, 3 Drawing Sheets

(56) References Cited

U.S. PATENT DOCUMENTS

| | | | | |
|---|---|---|---|---|
| 6,786,305 | B2 | 9/2004 | Kamimura et al. | |
| 7,232,011 | B2 | 6/2007 | Strebel et al. | |
| 7,316,294 | B2 | 1/2008 | Mustalahti et al. | |
| 7,581,621 | B2 | 9/2009 | Kontturi | |
| 8,087,497 | B2 | 1/2012 | Fargo | |
| 9,132,991 | B2 | 9/2015 | Husmann | |
| 9,643,818 | B2 | 5/2017 | Sen | |
| 2012/0097484 | A1* | 4/2012 | Cortona | B66B 11/022 187/249 |
| 2012/0318614 | A1* | 12/2012 | Husmann | B66B 11/022 187/249 |
| 2015/0122591 | A1 | 5/2015 | Kato | |
| 2017/0267490 | A1 | 9/2017 | Haapaniemi et al. | |

FOREIGN PATENT DOCUMENTS

| | | | | |
|---|---|---|---|---|
| JP | 4270642 | B2 * | 6/2009 | |
| JP | 2012188184 | A | 10/2012 | |
| KR | 20100020053 | A | 2/2010 | |
| WO | 2007/074206 | A1 | 7/2007 | |
| WO | WO-2012127683 | A1 * | 9/2012 | B66B 5/18 |

* cited by examiner

ELEVATOR CAB SUSPENSION ASSEMBLY FOR A DOUBLE DECK ELEVATOR

BACKGROUND

Elevator systems have proven useful for carrying passengers among various levels in buildings. Different building types present different challenges for providing adequate elevator service. Larger buildings that are more populated require increased elevator system capacity especially at peak travel times. Different approaches have been suggested for increasing elevator system capacity.

One approach is to increase the number of shafts or hoistways and elevator cars. This has obvious limitations because of the increased amount of building space required for each additional elevator. Another proposal has been to include more than one elevator car in a hoistway. Such arrangements have the advantage of increasing the number of cars without necessarily increasing the number of hoistways required within a building. One of the challenges associated with systems having multiple cars in a single hoistway is maintaining adequate spacing between the cars and ensuring that they do not interfere with each other.

Another suggested approach has been to utilize a double deck elevator car in which two cars are connected in a manner that they both move in the elevator hoistway together. Double deck elevators typically have heavier cars that require larger or more ropes, larger counterweights and larger motors. Each of these increase the cost of the system. Various arrangements have been proposed to allow for adjusting the spacing between the elevator cabs of a double deck elevator car. Some of the issues associated with such adjustment mechanisms are the limited amount of adjustment that is possible and the added weight, which adds to the need for a larger motor and counterweight.

SUMMARY

An illustrative example elevator system includes a frame, a first elevator cab, a second elevator cab, and a plurality of sheaves associated with the first and second elevator cabs, respectively. A suspension assembly suspends the first and second elevator cabs within the frame. The suspension assembly has two ends in a fixed position relative to the frame. The suspension assembly includes a positive drive load bearing member along a first portion of a length of the suspension assembly and at least one second load bearing member along a second portion of the length. A machine includes a drive sprocket that moves the positive drive load bearing member to cause movement of the first and second elevator cabs relative to the frame.

In an example embodiment having one or more features of the elevator system of the previous paragraph, the movement of the first and second elevator cabs relative to the frame comprises the first and second elevator cabs moving closer together when the drive sprocket rotates in a first direction and the first and second elevator cabs moving further apart when the drive sprocket rotates in a second, opposite direction.

In an example embodiment having one or more features of the elevator system of any of the previous paragraphs, the at least one second load bearing member comprises a rigid bar along some of the second portion of the length.

In an example embodiment having one or more features of the elevator system of any of the previous paragraphs, the at least one second load bearing member comprises a flexible member along a remainder of the second portion of the length and the flexible member is situated to wrap at least partially around the sheaves.

In an example embodiment having one or more features of the elevator system of any of the previous paragraphs, the rigid bar comprises a first bar section situated on one side of at least one of the elevator cabs and a second bar section situated on an opposite side of at least one of the elevator cabs. The flexible member comprises a section including one flexible member end coupled to one end of the first bar section and another flexible member end coupled to one end of the second bar section.

In an example embodiment having one or more features of the elevator system of any of the previous paragraphs, the flexible member comprises another section including one flexible member end coupled to an end of the chain and another flexible member end that remains in the fixed position relative to the frame.

In an example embodiment having one or more features of the elevator system of any of the previous paragraphs, the first bar section has another end coupled to an end of the chain.

In an example embodiment having one or more features of the elevator system of any of the previous paragraphs, the flexible member comprises at least one of a round rope and a flat belt.

In an example embodiment having one or more features of the elevator system of any of the previous paragraphs, the at least one second load bearing member comprises a flat belt, a first section of the flat belt has an end coupled to a first end of the positive drive load bearing member, and a second section of the flat belt has an end coupled to a second end of the chain.

In an example embodiment having one or more features of the elevator system of any of the previous paragraphs, the at least one second load bearing member comprises a round rope, a first section of the round rope has an end coupled to a first end of the positive drive load bearing member, a second section of the round rope has an end coupled to a second end of the positive drive load bearing member.

In an example embodiment having one or more features of the elevator system of any of the previous paragraphs, the first elevator cab is situated above the second elevator cab, some of the plurality of sheaves are situated above the first elevator cab for suspending the first elevator cab and others of the plurality of sheaves are situated below the second elevator cab for suspending the second elevator cab.

In an example embodiment having one or more features of the elevator system of any of the previous paragraphs, the frame comprises a plurality of vertically oriented frame members and a plurality of horizontally oriented frame members extending between the vertically oriented frame members, at least one of the horizontally oriented frame members being situated between the first and second elevator cabs.

In an example embodiment having one or more features of the elevator system of any of the previous paragraphs, the positive drive load bearing member comprises a chain.

In an example embodiment having one or more features of the elevator system of any of the previous paragraphs, the positive drive load bearing member comprises a toothed belt.

The various features and advantages of at least one disclosed example embodiment will become apparent to those skilled in the art from the following detailed description. The drawings that accompany the detailed description can be briefly described as follows.

DETAILED DESCRIPTION

Figure 1:
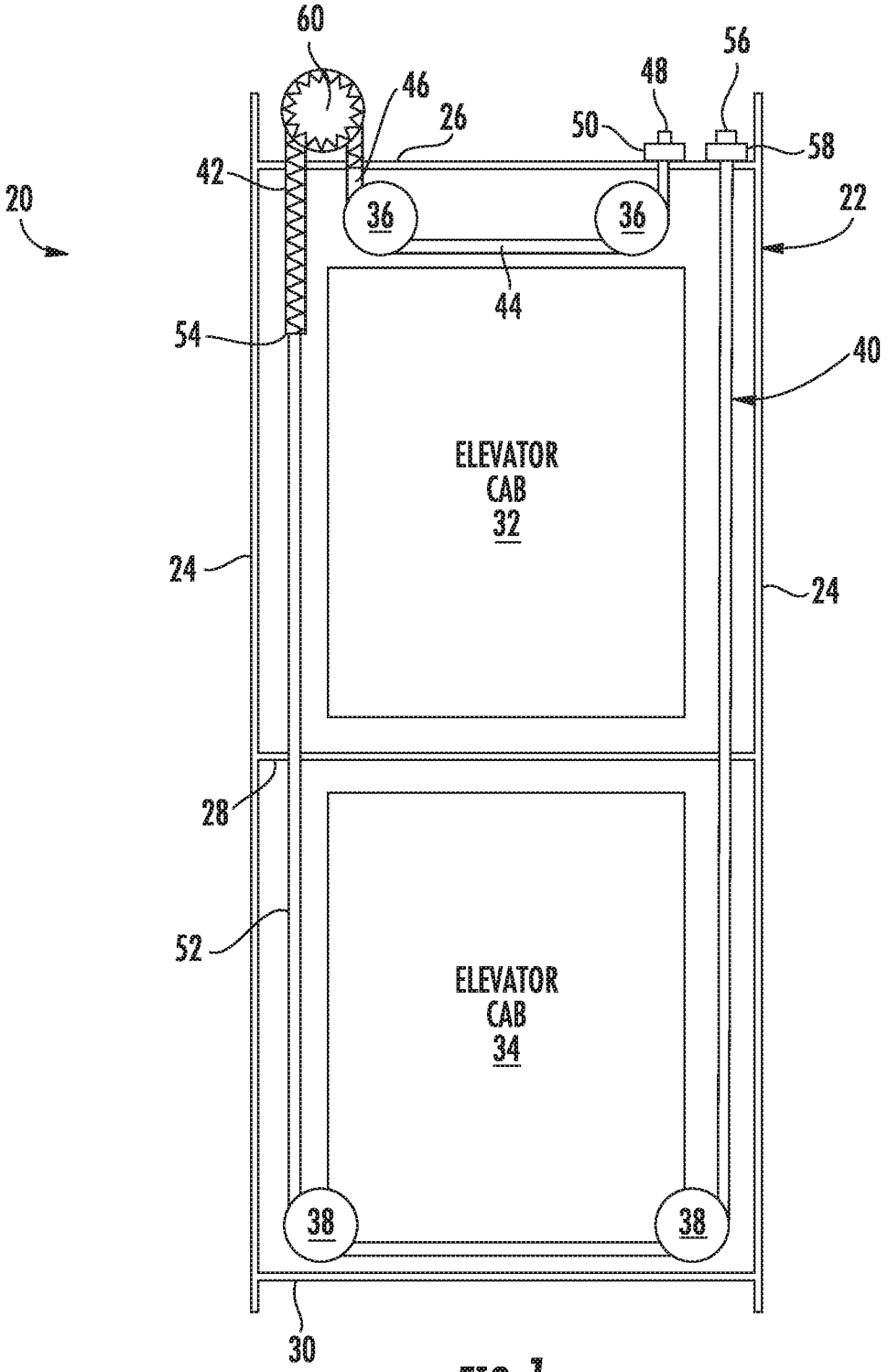
FIG. 1 schematically illustrates selected portions of an elevator system including a suspension assembly designed according to an embodiment of this invention.

FIG. 1 schematically illustrates selected portions of an elevator system 20 that includes a double deck car arrangement. A frame 22 includes vertically oriented frame members 24 and horizontally oriented frame member 26, 28 and 30.

Elevator cabs 32 and 34 are supported within the frame 22. A plurality of sheaves 36 are associated with the elevator cab 32 and a plurality of sheave 38 are associated with the elevator cab 34 to allow the cabs to be suspended within the frame 22 by a suspension assembly 40. To simplify the illustration and for purposes of discussion, a single suspension assembly 40 is shown in the figures. Some embodiments include multiple suspension assemblies aligned with each other.

The illustrated example suspension assembly 40 includes a positive drive load bearing member 42 and at least one other, second load bearing member that is different than the positive drive load bearing member. The second load bearing member in this example includes a first flexible member section 44 having one end coupled to a first end 46 of the chain 42. An opposite end 48 of the first flexible member section 44 is secured in a fixed position relative to the frame 22. In this example, a termination device 50 maintains the end 48 in a fixed position relative to the horizontally oriented frame member 26. The first flexible member section 44 at least partially wraps around the sheaves 36.

The second load bearing member in this example includes a second portion 52 having one end coupled to a second end 54 of the positive drive load bearing member 42. An opposite end 56 of the second portion 52 is secured in a fixed position relative to the frame 22. In this example, a termination device 58 secures the end 56 in a fixed position relative to the horizontally oriented frame member 26. The second portion 52 at least partially wraps around the sheaves 38.

The example elevator system 20 includes a machine having a drive sprocket 60 that provides a mechanical, positive drive connection between the machine and the positive drive load bearing member 42. The term sprocket as used in this document includes various configurations of a positive drive wheel including a toothed wheel and a gear. In some embodiments the positive drive load bearing member 42 comprises a chain. In other embodiments, the positive drive load bearing member 42 comprises a toothed belt. For discussion purposes, the illustrated example embodiment is described as including a chain and those skilled in the art will understand how the positive drive aspects of this embodiment apply to other embodiments with other positive drive load bearing members.

The elevator cabs 32 and 34 are suspended by the suspension assembly 40 in a manner that allows the elevator cabs 32 and 34 to have different spacings between them. As the sprocket 60 rotates in a clockwise direction, for example, the elevator cab 32 moves downward toward the elevator cab 34 and the elevator cab 34 moves upward toward the elevator cab 34. When the sprocket 60 rotates in a counterclockwise direction, the elevator cabs 32 and 34 move further apart from each other and relative to the frame 22.

The other load bearing member having the portions 44 and 52 in this embodiment comprises a flexible member. In some embodiments, the flexible member is a round rope, which may comprise steel. In other embodiments, the flexible member sections 44 and 52 comprise a flat belt.

Using different materials for different sections of the suspension assembly 40 allows for achieving the benefits of having a positive drive connection between a sprocket 60 and chain 42 while also having the ability to select materials for the suspension assembly 40 to realize cost and weight reductions. One of the challenges faced by designers of double deck elevator systems is the additional weight and cost associated with a mechanism for moving the two elevator cabs relative to each other. The illustrated example embodiment provides greater freedom of movement while reducing cost and weight.

The illustrated example embodiment allows for adjusting the distance or spacing between the elevator cabs 32 and 34 in any amount that can be accommodated within the frame 22. For buildings in which a lobby level has an extended height compared to other levels within the building, the frame 22 may be designed to accommodate a spacing large enough between the elevator cab 32 and 34 to allow one of the cabs to service the lobby floor while the other services an adjacent floor regardless of the height of the ceiling in the lobby. Other double deck elevator arrangements did not have an ability to accommodate such a large variety of building configurations because they relied on a pantograph linkage and those can only accommodate a more limited range of motion unless the pantograph is very large, which undesirably would add more weight.

Figure 2:
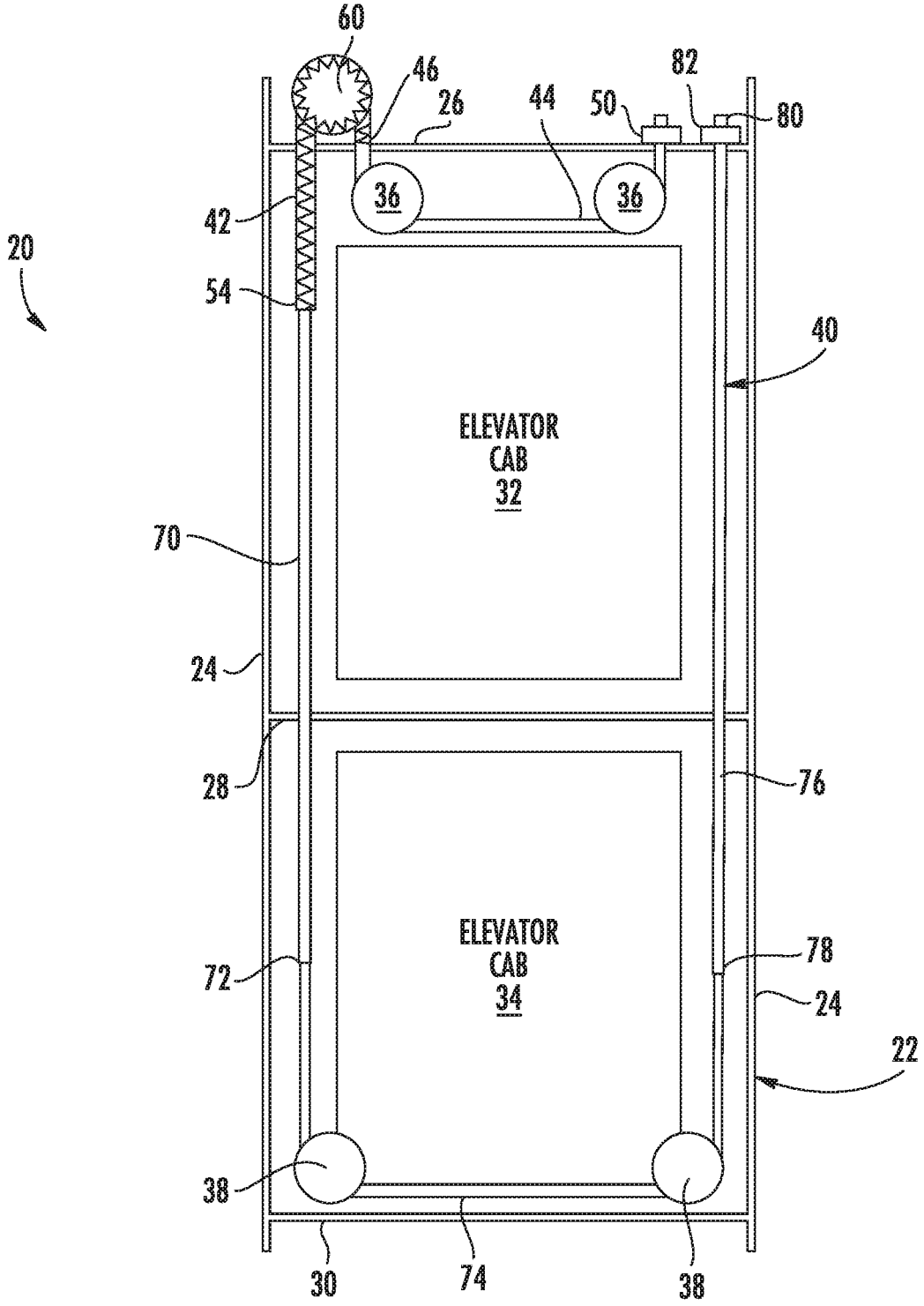
FIG. 2 schematically illustrates an elevator system including another example suspension assembly.

FIG. 2 illustrates another example embodiment in which the suspension assembly 40 includes a chain 42 and a flexible load bearing member section 44 like those included in the embodiment of FIG. 1. The suspension assembly 40 in this example includes a rigid bar 70 having one end coupled to the second end 54 of the chain 42. An opposite end 72 of the rigid bar 70 is coupled to one end of a flexible load bearing member 74. An opposite end 78 of the flexible load bearing member 74 is coupled to a second rigid bar 76. An opposite end 80 of the rigid bar 76 is secured in a fixed position relative to the frame 22 by a connector 82.

The rigid bars 70 and 76 comprise elongated rigid bodies made of a metal or polymer material. The bars 70 and 76 in some embodiments are solid while in other embodiments they are hollow.

The rigid bars 70 and 76 are situated on opposite sides of at least one of the elevator cabs 32, 34 along portions of the suspension assembly 40 that do not interact with the sheaves 36 or 38 for the entire range of movement of the elevator cabs 32 and 34 relative to the frame 22. Only the chain 42 interacts with the sprocket 60 in the illustrated embodiments.

Utilizing rigid bars can provide additional cost savings and, in some embodiments, additional weight reduction depending on the chosen material for the rigid bars 70 and 76.

The flexible load bearing member sections 44 and 74 in the embodiment of FIG. 2 may comprise a round rope, a chain or a belt.

Figure 3:
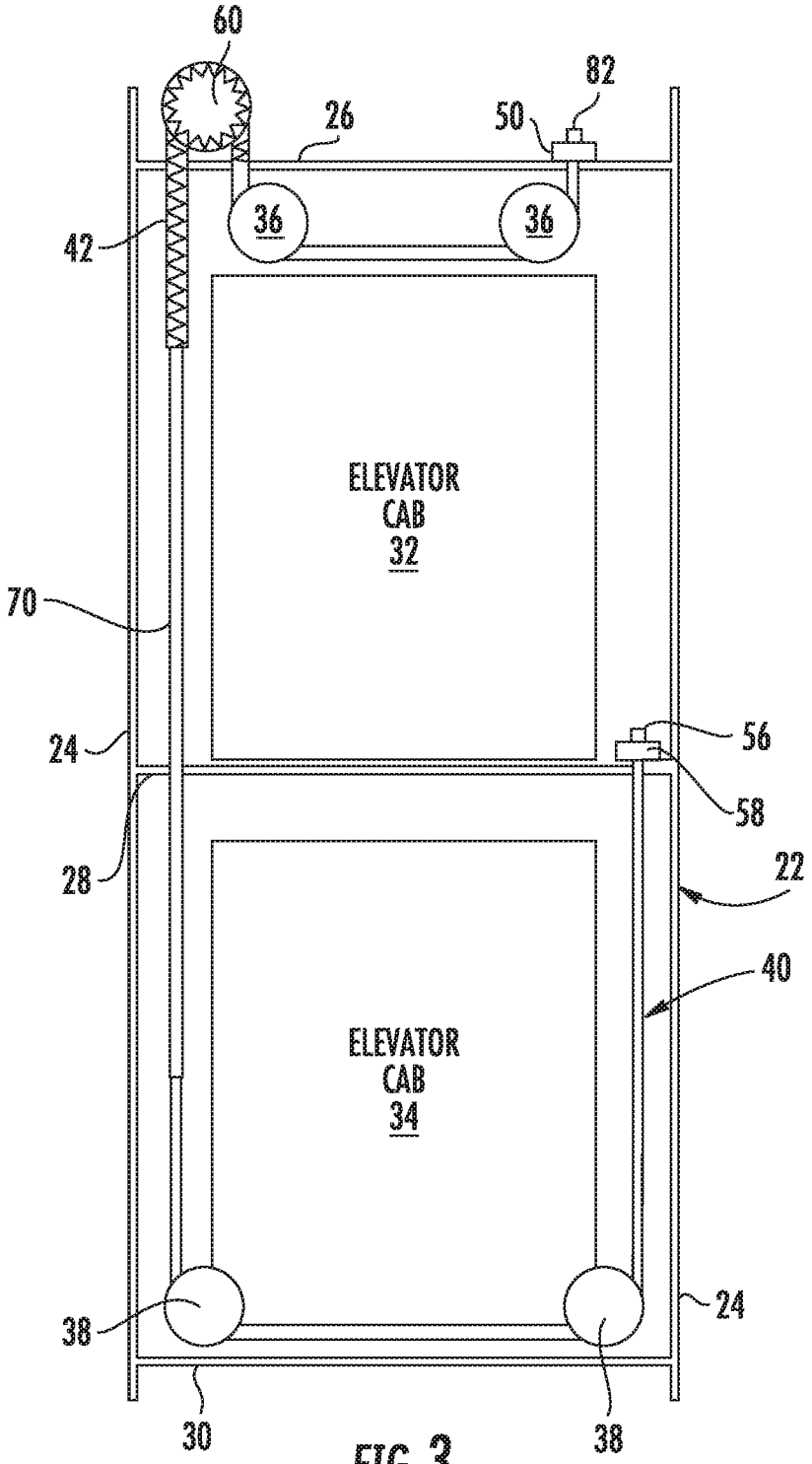
FIG. 3 schematically illustrates another example embodiment.

FIG. 3 illustrates an embodiment that may include either of the suspension assembly 40 configurations described above. In this example, the termination device 58 and end 56 are secured in a fixed position on the intermediate horizontal frame member 28. Another difference between this embodiment and those shown in FIGS. 1 and 2 is that a single rigid rod 70 is included as part of the suspension assembly 40.

Different embodiments are shown with different features, respectively. Those features are not necessarily limited to the specific combinations shown. Other combinations or variations are possible for realizing other or additional embodiments.

The suspension assemblies 40 of the illustrated examples include different materials along different portions of the length of the suspension assembly 40. Utilizing different materials allows for achieving different performance characteristics of the suspension assembly 40, provides cost savings, and allows for realizing a lighter weight double deck elevator arrangement.

Utilizing a positive drive, such as a chain and sprocket arrangement, avoids any slippage between the suspension assembly 40 and the drive sprocket 60. If a rope or belt were used to interface with a smooth traction sheave, there is either insufficient traction to accommodate various combinations of different loads in the respective elevator cabs. Elevator codes require handling 125% overload in either cab while the other is empty and that requires a large friction drive traction capacity. Sufficient traction typically cannot be achieved without a complicated sheave arrangement that includes wrap angles that exceed 180°. More complex sheave arrangements increase cost and the amount of space required to accommodate the entire arrangement.

Satisfying the 40:1 sheave to rope diameter ratio required by elevator codes requires a large traction sheave and a high torque motor, both of which increase cost, size and weight. Using a positive drive load bearing member along at least the portion of the suspension assembly that interfaces with a drive sprocket arrangement avoids slippage and allows for a smaller diameter sprocket compared to a traction sheave that would be required to establish a traction-based coupling between the suspension assembly 40 and the machine responsible for moving it relative to the frame 22. Smaller components reduce cost and weight. Any weight reduction is desirable in a double deck elevator system for the reasons noted above.

The positive drive aspects of the disclosed example embodiments also allow for greater freedom in double deck elevator design. The space between the cabs can be smaller or larger than was possible with traditional scissor-based connections between the cabs. Such mechanisms limit the largest possible spacing between the cabs because of the length of the links and limit the smallest possible spacing because of the presence of the scissor mechanism between the cabs. A suspension assembly like that included in the example embodiments, on the other hand allows for significant changes in spacing between the cabs from very close together to as far apart as the supporting frame will allow. Having such versatility allows the elevator system to be compatible with a wider variety of building configurations in which the height of one or more floors may be significantly different than others in the same building. Additionally, this greater versatility comes without the cost of larger or more expensive components.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

a frame;

a first elevator cab;

a second elevator cab;

a plurality of sheaves associated with the first and second elevator cabs, respectively;

a suspension assembly that suspends the first and second elevator cabs within the frame, the suspension assembly having two ends in a fixed position relative to the frame and a length between the two ends, the suspension assembly comprising a positive drive load bearing member that defines a first portion of the length of the suspension assembly and at least one other second load bearing member that is different than the positive drive load bearing member that defines a second portion of the length between the first portion and one of the two ends; and a machine including a drive sprocket that moves the positive drive load bearing member to cause movement of the first and second elevator cabs relative to the frame, wherein only the positive drive load bearing member is configured for a positive drive connection with the drive sprocket.

2. The elevator system of claim 1, wherein the movement of the first and second elevator cabs relative to the frame comprises the first and second elevator cabs moving closer together when the drive sprocket rotates in a first direction; and the first and second elevator cabs moving further apart when the drive sprocket rotates in a second, opposite direction.

3. The elevator system of claim 1, wherein the at least one second load bearing member comprises a rigid bar along some of the second portion of the length.

4. The elevator system of claim 3, wherein the at least one second load bearing member comprises a flexible member along a remainder of the second portion of the length; and the flexible member is situated to wrap at least partially around the sheaves.

5. The elevator system of claim 4, wherein the rigid bar comprises a first bar section situated on one side of at least one of the elevator cabs and a second bar section situated on an opposite side of at least one of the elevator cabs; and the flexible member comprises a section including one flexible member end coupled to one end of the first bar section and another flexible member end coupled to one end of the second bar section.

6. The elevator system of claim 5, wherein the flexible member comprises another section including one flexible member end coupled to an end of the positive drive load bearing member and another flexible member end that remains in the fixed position relative to the frame.

7. The elevator system of claim 6, wherein the first bar section has another end coupled to an end of the positive drive load bearing member.

8. The elevator system of claim 4, wherein the flexible member comprises at least one of a round rope, a chain, a toothed belt and a flat belt.

9. The elevator system of claim 1, wherein the at least one second load bearing member comprises a flat belt; and a first section of the flat belt has an end coupled to a first end of the positive drive load bearing member.

10. The elevator system of claim 9, wherein a second section of the flat belt has an end coupled to a second end of the positive drive load bearing member.

11. The elevator system of claim 1, wherein the at least one second load bearing member comprises a round rope; and a first section of the round rope has an end coupled to a first end of the positive drive load bearing member.

12. The elevator system of claim 11, wherein a second section of the round rope has an end coupled to a second end of the positive drive load bearing member.

13. The elevator system of claim 1, wherein the positive drive load bearing member comprises a chain.

14. The elevator system of claim 1, wherein the positive drive load bearing member comprises a toothed belt.

15. The elevator system of claim 1, wherein the first elevator cab is situated above the second elevator cab;

some of the plurality of sheaves are situated above the first elevator cab for suspending the first elevator cab; and others of the plurality of sheaves are situated below the second elevator cab for suspending the second elevator cab.

16. The elevator system of claim 1, wherein the frame comprises a plurality of vertically oriented frame members; and a plurality of horizontally oriented frame members extending between the vertically oriented frame members, at least one of the horizontally oriented frame members being situated between the first and second elevator cabs.

17. An elevator system, comprising:

a frame;

a first elevator cab;

a second elevator cab;

a plurality of sheaves associated with the first and second elevator cabs, respectively;

a suspension assembly that suspends the first and second elevator cabs within the frame, the suspension assembly having two ends in a fixed position relative to the frame, the suspension assembly comprising a positive drive load bearing member along a first portion of a length of the suspension assembly and at least one other second load bearing member that is different than the positive drive load bearing member along a second portion of the length;

a machine including a drive sprocket that moves the positive drive load bearing member to cause movement of the first and second elevator cabs relative to the frame;

wherein the at least one second load bearing member comprises a rigid bar along some of the second portion of the length, wherein the at least one second load bearing member comprises a flexible member along a remainder of the second portion of the length;

the flexible member is situated to wrap at least partially around the sheaves;

wherein the rigid bar comprises a first bar section situated on one side of at least one of the elevator cabs and a second bar section situated on an opposite side of at least one of the elevator cabs;

the flexible member comprises a section including one flexible member end coupled to one end of the first bar section and another flexible member end coupled to one end of the second bar section; and wherein the flexible member comprises another section including one flexible member end coupled to an end of the positive drive load bearing member and another flexible member end that remains in the fixed position relative to the frame.

18. The elevator system of claim 17, wherein the first bar section has another end coupled to an end of the positive drive load bearing member.

19. An elevator system, comprising:

a frame;

a first elevator cab;

a second elevator cab;

a plurality of sheaves associated with the first and second elevator cabs, respectively;

a suspension assembly that suspends the first and second elevator cabs within the frame, the suspension assembly having two ends in a fixed position relative to the frame, the suspension assembly comprising a positive drive load bearing member along a first portion of a length of the suspension assembly and at least one other second load bearing member that is different than the positive drive load bearing member along a second portion of the length;

a machine including a drive sprocket that moves the positive drive load bearing member to cause movement of the first and second elevator cabs relative to the frame;

wherein the at least one second load bearing member comprises a flat belt or a round rope; and a first section of the flat belt or round rope has an end coupled to a first end of the positive drive loadbearing member.

20. The elevator system of claim 19, wherein a second section of the flat belt or round rope has an end coupled to a second end of the positive drive load bearing member.

* * * * *